United States Patent [19]

Remery

[11] 4,279,543

[45] Jul. 21, 1981

[54] DEVICE FOR CONVEYING A MEDIUM FROM MEANS PROVIDED IN A FIXED POSITION ON A BOTTOM BELOW THE WATER SURFACE TO A BUOY BODY

[75] Inventor: George F. M. Remery, Eze-sur-Mer, France

[73] Assignee: Single Buoy Moorings, Inc., Fribourg, Switzerland

[21] Appl. No.: 49,655

[22] Filed: Jun. 18, 1979

[30] Foreign Application Priority Data

Jun. 20, 1978 [NL] Netherlands ..... 7806649

[51] Int. Cl.[3] ..... E02B 17/00

[52] U.S. Cl. ..... 405/195; 405/210; 141/388

[58] Field of Search ..... 405/210, 201-208, 405/196, 195; 141/388

[56] References Cited

U.S. PATENT DOCUMENTS

| | | | |
|---|---|---|---|
| 2,140,811 | 12/1938 | Poole | 141/388 X |
| 2,594,105 | 4/1952 | Watts | 405/210 X |
| 3,154,118 | 10/1964 | Silveston | 141/388 |
| 3,228,421 | 1/1966 | Sheiry | 141/388 X |
| 3,236,266 | 2/1966 | Bily | 141/388 X |
| 3,452,787 | 7/1969 | Bily | 141/388 |
| 3,535,883 | 10/1970 | Manning | 405/210 |
| 3,855,809 | 12/1974 | Westling | 405/210 |
| 4,026,119 | 5/1977 | Dotti | 141/388 X |

*Primary Examiner*—Dennis L. Taylor

*Attorney, Agent, or Firm*—Young & Thompson

[57] ABSTRACT

When a flexible conduit is secured to a buoy under water, the action of the tide, current, wind and waves, as well as forces exerted by a vessel moored to the buoy, cause the buoy to perform various motions that bend or twist the tube and load it with additional tractive forces. This causes the tube to wear very quickly and to have to be replaced. The present invention solves this problem, by replacing that portion of the tube adjacent the buoy, by a pipe or rod which is fastened to the buoy with a universal joint and which hangs downwardly from the buoy in the water. At the lower end of the pipe or rod, a tube is connected which continues to the bottom of the body of water. The tube is coupled with the pipe or is directed through or along the rod, to the buoy.

4 Claims, 1 Drawing Figure

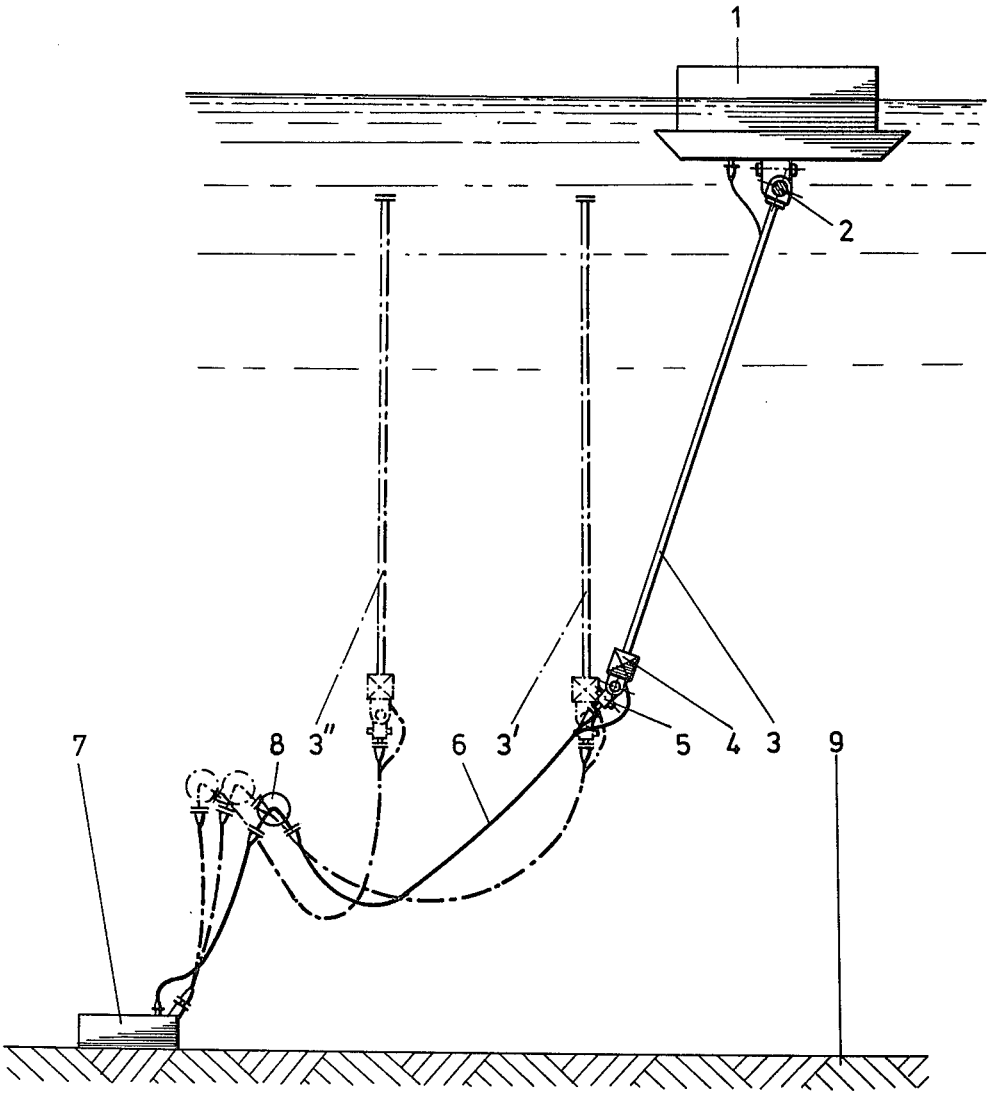
1
2
3
3'
3"
4
5
6
7
8
9

DEVICE FOR CONVEYING A MEDIUM FROM MEANS PROVIDED IN A FIXED POSITION ON A BOTTOM BELOW THE WATER SURFACE TO A BUOY BODY

The invention relates to a device for conveying a medium from a means provided in a fixed position on a bottom below the water surface to an anchored buoy body floating on the water, comprising a conduit connected to said means and extending to the buoy body of which conduit at least the part connected to said means consists of a flexible tube.

In the known devices of this type the entire conduit usually consists of a flexible tube. Under the influence of forces caused by the tide, current, wind, and wave action as well as forces exerted by a vessel moored to the buoy, the anchored buoy may perform vertical, horizontal and swinging motions within the restrictions determined by the anchor cables or chains, whereby the tube may be bent and/or twisted and be loaded with an additional tractive force. Moreover, when moving, the tube is subjected to resistance forces exerted by the surrounding water, whereas in the turbulent part of the water mass currents and wave motions will act on the tube. Such lines entirely consisting of a tube will therefore wear very quickly and have to be replaced regularly.

The object of the invention is to provide a device of the above mentioned type in which this drawback is avoided.

This object is attained in that in the device according to the invention a pipe or rod is fastened to the buoy body by means of a universal joint, said pipe or rod in the operative condition of the device hanging downwardly from the buoy in the water, while at the lower end of the pipe or rod a tube connected to said means is coupled with the pipe or is directed through or along the rod. In addition a buoyant body may be fastened to the tube at a position between the connections with said means and said pipe or rod.

The pipe or rod suspends from the buoy and will but little deviate from this position under the influence of currents and the swell whereas possible swinging motions will be damped by the surrounding water so that the lower end of the pipe or rod will move but little. By means of the buoyant body fastened to the tube it is prevented that the tube portion of the conduit will grate over the bottom whereas due to the presence of said buoyant body the tube may moreover make but small movements with respect to said means.

It is preferred that close to the lower end of the pipe or rod a weight is provided on the pipe or rod whereby the influence of currents will be lessened.

The tube may be coupled to the pipe by means of a universal joint.

It is noted that the Dutch Patent Application No. 72.03231 discloses a device of the aforesaid type in which the entire line between the buoy and said means consists of pipe sections which are coupled with each other and with the buoy and the said means by means of universal joints so that not even a single free tube portion is present. Such a solution of the problem is however expensive.

The invention will now be described in detail with reference to the embodiment schematically shown in the drawing.

With reference to the drawing there is shown a device including a buoy 1 that is anchored with respect to the bottom by means of anchor (not shown) chains and anchors. By means of the universal joint 2 a pipe 3 is fastened to the buoy body 1 which pipe in fact hangs vertically downwardly from the buoy 1 in the water. A weight 4 is provided on the lower end of the pipe 3. A tube 6 is coupled with the lower end of the pipe 3 by means of the universal joint 5, while the other end of the tube is connected to a means 7 provided in a fixed position on the bottom 9, which means may for instance be a distribution member of a submerged pipe line. Furthermore a buoyant body 8 is fastened to the tube 6.

In the drawing there is indicated in full lines a position of the buoy body 1 in which position the pipe 3 has performed a large movement with respect to the buoy. The position of the pipe 3' indicated in dashed lines is the position corresponding to the buoy 1 in unloaded condition, whereas by 3'' the position of the pipe 3 is indicated for another position of the buoy 1.

I claim:

1. In a device for conveying a medium from a means provided in a fixed position on a bottom below the water surface to an anchored buoy body floating on the water, comprising a conduit connected to said means and extending to the buoy body, of which conduit at least the part connected to said means consists of a flexible tube; the improvement comprising a pipe or rod is fastened to the buoy body by means of a universal joint, said pipe or rod in the operative condition of the device hanging downwardly from the buoy in the water, while at the lower end of the pipe or rod a tube connected to said means is coupled with the pipe or is directed through or along the rod.

2. The device of claim 1, in which adjacent the lower end of the pipe or rod a weight is provided on the pipe or rod.

3. The device of claim 1, in which at a position between the connections with said means and said pipe or rod a buoyant body is provided on the tube.

4. The device according to the claim 1, in which the tube is coupled with the pipe by means of a universal joint.

* * * * *